United States Patent [19]

Buscher et al.

[11] 4,020,324

[45] Apr. 26, 1977

[54] WEAPON DELIVERY SYSTEM

[75] Inventors: Richard George Buscher, Woodland Hills; Peter Eugene Carnevale, Canoga Park, both of Calif.

[73] Assignee: Lear Siegler, Inc., Santa Monica, Calif.

[22] Filed: Feb. 23, 1976

[21] Appl. No.: 660,471

Related U.S. Application Data

[63] Continuation-in-part of Ser. No. 500,531, Aug. 26, 1974, abandoned.

[52] U.S. Cl. ..... 235/61.5 S; 89/41 EA; 235/61.5 R; 356/29

[51] Int. Cl.[2] ..... G06F 15/58; B64D 7/08

[58] Field of Search ..... 235/61.5 R, 61.5 S, 235/61.5 D; 356/4, 29; 89/1.5 E, 41 AA, 41 EA

[56] References Cited

UNITED STATES PATENTS

| | | | |
|---|---|---|---|
| 3,128,623 | 4/1964 | Gold | 356/29 |
| 3,383,987 | 5/1968 | MacMillan | 89/41 EA |
| 3,551,688 | 12/1970 | Edelson et al. | 235/61.5 R |
| 3,699,310 | 10/1972 | Cole | 235/61.5 D |
| 3,723,005 | 3/1973 | Smith et al. | 89/1.5 E |
| 3,880,043 | 4/1975 | Cox et al. | 235/61.5 D |

*Primary Examiner*—Felix D. Gruber
*Attorney, Agent, or Firm*—Ralph Pastoriza

[57] ABSTRACT

An aircraft weapon delivery system includes in combination with the usual computer for solving fire control equations and a display generator displaying a firing pipper, further circuitry for generating a reticle for viewing on the display such that command signals from the computer responsive to movement of the aircraft control stick are passed directly to the display to move the reticle without lag time to a registering position with a target viewed by the pilot. By providing the generated reticle in the form of a circle together with manual controls operable by the pilot for passing a variable reticle signal for varying the diameter of the circle, the pilot can adjust the circle size to match the visual target, the reticle signal then constituting a function of the range of the target and the rate that the pilot must vary the reticle signal to maintain a matching with the visual target constituting a function of the rate of change of range. These pieces of information can then be fed directly to the computer and thereby avoid the necessity of line-of-sight tracking and ranging radar equipment.

2 Claims, 6 Drawing Figures

Register

Track

Fire

WEAPON DELIVERY SYSTEM

This application is a continuation-in-part of our copending application Ser. No. 500,531 filed Aug. 26, 1974 and now abandoned, entitled WEAPON DELIVERY SYSTEM.

This invention relates to weapon delivery systems particularly of the type for use on an aircraft wherein the aircraft weapon is fixed to the aircraft fuselage and is pointed in the proper firing direction to hit a target by aligning the fuselage in such direction.

BACKGROUND OF THE INVENTION

Known weapon delivery systems to aid a pilot in shooting an enemy target in air-to-air or air-to-ground combat usually incorporate computers for solving fire control equations. The computer is normally fed with air data information including velocity, angle of attack, and side slip angle. In addition, an inertial system provides inertial attitude and accelerations. Also, by the use of radar, the range and angular direction of a target are fed to the computer. The computer generates a firing pipper which is displayed in a position to be observed by the pilot in his line of sight when chasing an enemy aircraft and by utilizing the firing pipper as a guide, the pilot attempts to position the aircraft fuselage in the proper firing direction.

Generally, the foregoing systems are of two general types. The first type is referred to as the "disturbed reticle sight" in which a lead angle is computed based on target range measurement by the radar system, and a rate gyro system that measures body angular rates. The principal disadvantage of this type of system is the oscillatory effect that results due to the equations that must be used. In addition, the pilot must estimate the range rate and use it to "lead" the target with the reticle beyond the computed lead angle.

The second type is referred to as the "director sight" in which not only range, but range rate is measured by a radar sensor and a line-of-sight tracker is used to obtain the target aircraft's relative location in space. An inertial platform is used to obtain the attacking aircraft's location and motions in space. The computations which involve the attacking aircraft's position and the target or enemy aircraft relative position, are used to generate a symbol which should fall directly on the target. The pilot needs to fly the aircraft to keep the symbol in his sight area. He may then fire his weapon whenever the symbol is on the target. The disadvantage of this system is the requirement for the line-of-sight tracker and the radar sensor which are subject to noise and jamming. Also, it cannot be used in air-to-ground weapon delivery since a ground target cannot be so easily distinguished from background in the tracker and radar return.

A major problem in all types of prior art weapon delivery systems in which a display is provided for the pilot resides in the lag time (referred to as "settling time") inherent when the pilot moves his controls and the aircraft is actually maneuvered to the new position in response to the command signals from the controls. The situation is particularly aggravated in air-to-air combat wherein the pilot attempts to place a tracking symbol on his display on the enemy aircraft. By way of example, if the enemy aircraft appears in the upper right hand portion of the display and the tracking symbol which may be a firing pipper, gun line, or other symbol to be superimposed on the target is elsewhere on the display, the pilot will move his controls to maneuver the aircraft such that its fuselage will point upwardly and to the right to effect the desired registration. However, movement of the controls by the pilot is translated into electrical signals which pass into the computer, portions of the computer in turn interpreting these signals and passing them to the flight control surfaces to actually physically move the flight control surfaces in a manner to cause the entire aircraft to assume the desired position. The time lag taken for the aircraft to assume the position commanded by the pilot is of such length that when the maneuver is completed the target is no longer at the originally observed location and thus a further correction must be made by the pilot and a further lag time is involved for the actual physical positioning of the aircraft to take place.

The net result of all the foregoing is an "oscillation" effect which occurs not only through the feedback of the pilot's senses but also in the fire control equations solved by the computer.

In summary, with present systems, it is difficult to align a symbol on the display on a rapidly moving enemy aircraft, wherein such alignment relies on a proper positioning of the entire aircraft fuselage, without the aforementioned lag time.

BRIEF DESCRIPTION OF THE PRESENT INVENTION

With the foregoing in mind, the present invention contemplates an improved weapon delivery system particularly in the display portion thereof wherein the problem of lag time between a pilot operating his controls and actual responsive positioning of the aircraft is essentially overcome or at least substantially reduced in the tracking of an enemy aircraft. In addition, the invention provides a means for providing line-of-sight, range and range rate information of a target directly to the computer thereby avoiding the necessity of line-of-sight and radar ranging equipment so that the entire system is useful in air-to-ground operations wherein the use of trackers and radar heretofore has not been feasible because of the inability to distinguish the ground target from background radar return.

In accord with the invention, a display generator projects a reticle on the display means in the aircraft along with the usual firing pipper. The arrangement is such that command signals from the computer responsive to movement of the control stick are passed directly to the display generator to move the reticle without lag time to a registering position with a target viewed by the pilot. As a consequence, the pilot can register and track the target with substantial ease with the reticle since it moves directly in response to his movements of the control stick. The reticle position on the display is the line-of-sight information required by the system computations, thus avoiding the need for line-of-sight tracking equipment, While carrying out the direct tracking, the computer effects the actual positioning of the aircraft in a manner to superimpose the firing pipper on the target. The weapon can then be fired.

In accord with a further feature of the invention the generated reticle on the display is in the form of a circle the diameter of which can be manually controlled by the pilot. In this respect, the pilot passes a variable reticle signal to the computer for controlling the display means in such a manner that the diameter of the circle can be varied to match the visual target. The value of the reticle signal at any given time thus constitutes a function of the range of the target and the rate that the pilot must vary the reticle signal to maintain a matching with the visual target size as it varies constitutes a function of the rate of change of range. Angle, range and range rate are thus provided through the pilot and the need for radar ranging equipment to provide this information to the computer is avoided.

BRIEF DESCRIPTION OF THE DRAWINGS

A better understanding of the present invention will be had by now referring to the accompanying drawings in which.

DETAILED DESCRIPTION OF THE INVENTION

Figure 1:
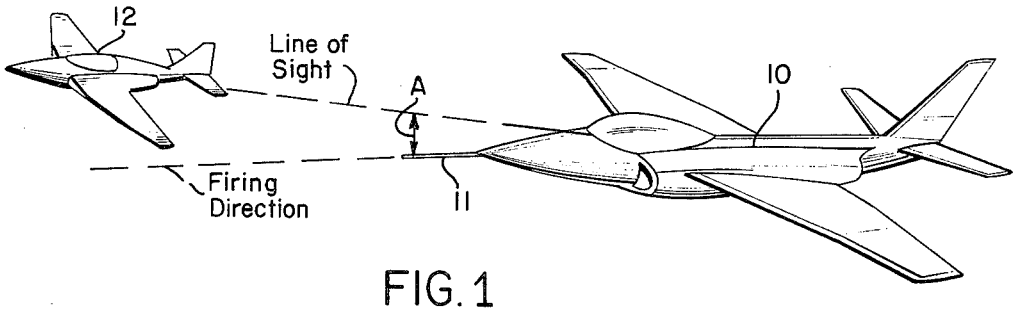
FIG. 1 is a perspective view of an attacking aircraft and enemy aircraft target wherein the system of the present invention is utilized.

Referring to FIG. 1, there is shown an aircraft 10 including the weapon delivery system of the present invention. While the particular aircraft 10 is merely shown schematically, it is of the type incorporating a firing weapon which is fixed to the fuselage so that in pointing the weapon, the entire aircraft itself is pointed in the proper direction. Sophisticated versions of this type of aircraft include direct lift and side force surfaces allowing the vehicle flight path and attitude to be controlled independently. In other words, the aircraft fuselage can be controlled in translation in the three dimensional frame independently (within some design limits) of the instantaneous flight path. Such rapid orientation means reduces to some extent the lag time between command signals manually provided by the pilot and the actual positioning of the aircraft fuselage for firing.

In FIG. 1, there is schematically indicated at 11 a weapon fixed to the fuselage 10, the firing direction of the weapon 11 being indicated as the direction of the fuselage.

It will be noted that this firing direction is out of alignment with a target aircraft 12. The line of sight of the target aircraft 12 forms an angle A with the firing direction as indicated. To assure a hit of the aircraft 12 by the weapon in aircraft 11, the aircraft fuselage is pointed in the proper firing direction (taking into account lead time and the like) to hit the target. The angle A of the line of sight of the target with the firing direction is thus one of the parameters that is fed into the fire control computer. This variable along with the range of the enemy aircraft and the rate of change of the range relative to the attacking aircraft, as mentioned, is normally provided by a ranging radar.

Figure 2:
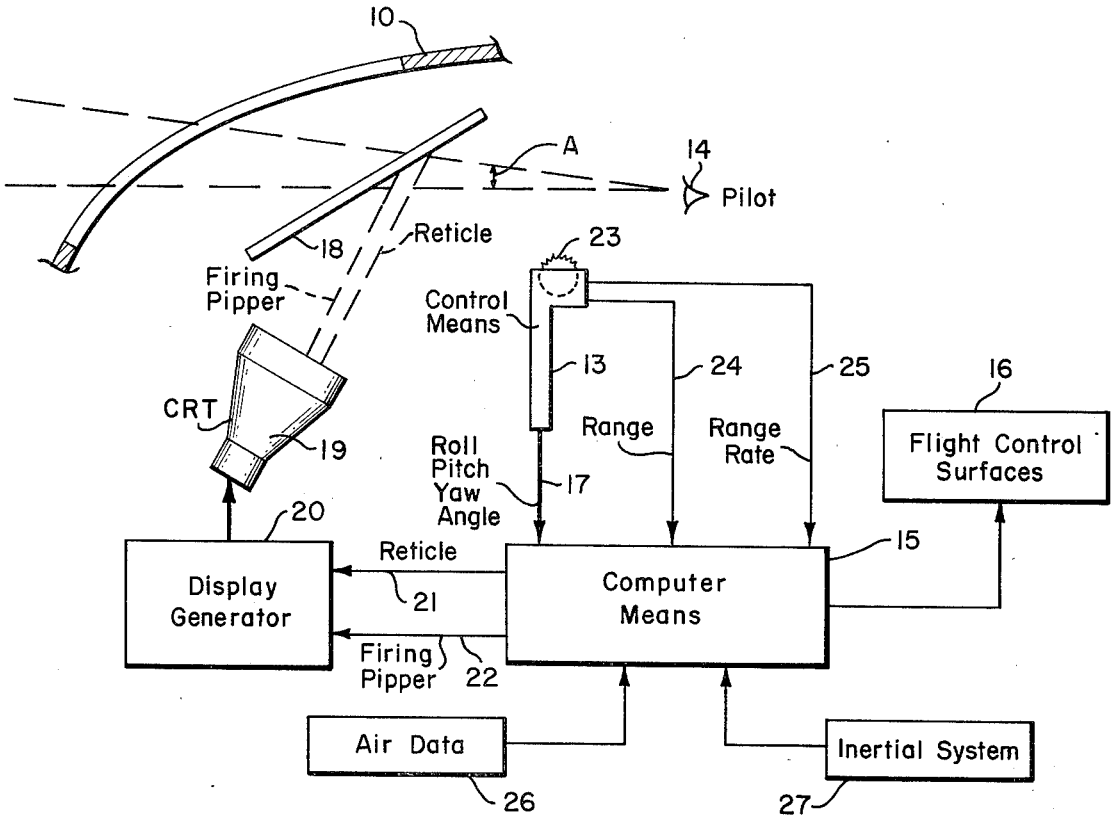
FIG. 2 is a block diagram partly schematic in form showing the basic components of the weapon delivery system utilized in the attacking aircraft of FIG. 1.

Referring now to FIG. 2, there is schematically indicated at 13 the pilot's control means, the pilot himself being depicted by the symbol 14 looking through the windshield of the cockpit of the aircraft 10. In maneuvering the aircraft, suitable command signals from the control means 13 which includes a stick or wheel and the pedals are fed to a computer means 15 providing suitable output signals to the flight control surfaces as indicated at 16. The computer means 15 also functions to solve the usual firing equations. The command signals from the control means 13 are indicated as roll, pitch, yaw and the angle of the target aircraft between the line-of-sight and firing direction as described in FIG. 1. These signals are passed to the computer on line 17 as shown.

A head-up display means (often referred to as HUD) includes a partially transmitting mirror 18 positioned in the line of sight of the pilot 14 upon which a display is projected by a cathode ray tube 19 connected to a display generator 20. As indicated, the display generator 20 receives two major pieces of information from the computer means 15. The first, in accord with the present invention, is a reticle signal on line 21. The second is the usual firing pipper position information on line 22. The position of the reticle 21 on the cathode ray tube 19 can be observed in the partially transmitting mirror 18 along with the position of the firing pipper.

Essentially, and in accord with the present invention, command signals from the computer responsive to movement of the control means 13 are not only processed and sent to the flight control surfaces 16 but also processed and passed directly to the display generator along line 21 to move the displayedreticle without lag time to a position as commanded by signals from the control stick. In other words, the pilot can directly move the reticle display in response to movement of his control means rather than await the time taken for the entire aircraft fuselage to be moved and thereby move a reticle or symbol on the display relative to the target aircraft.

In the particular embodiment illustrated, there is provided a vernier means manually controllable by the pilot in the form, for example, of a small thumb wheel operated potentiometer 23 for passing a variable reticle signal to the computer on line 24. This reticle signal enables the pilot to manually control the reticle which is in the form of a circle in a manner to vary the diameter of the circle. In addition, a differentiating circuit may be provided in the manual control 23 to provide a reticle signal constituting a function of the rate of change of the reticle circle diameter, this information being passed to the computer means 15 on line 25. In an actual embodiment, the range rate signal would be computed from the range signal in the computer 15.

The system of FIG. 2 is completed by the usual air data input information provided by block 26 which inclues velocity, angle of attack, and side slip angle. These signals are used by the computer in solving the weapon delivery equations. In addition, an inertial system 27 provides signals relating to the inertial attitude and accelerations of the aircraft 10.

Figure 3:
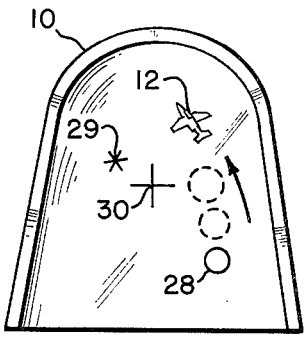
FIG. 3 schematically depicts the display observed by a pilot looking out the front of the aircraft in tracking the enemy target at an initial stage of pursuit.

FIG. 3 shows the view that is presented to the pilot 14 of FIG. 2 when tracking an enemy aircraft. The generated reticle is shown in the form of a circle 28. The firing piper position established by the computer means is shown at 29 and the usual gun line reference 30 which indicates the actual physical direction in which the weapon and fuselage of the aircraft point. Also shown in FIG. 3 is the target aircraft 12.

Figure 4:
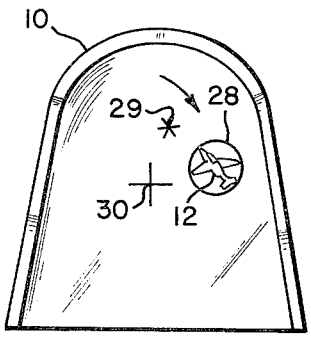
FIG. 4 is a view similar to FIG. 3 showing a subsequent position of various displays during an attack.
Figure 5:
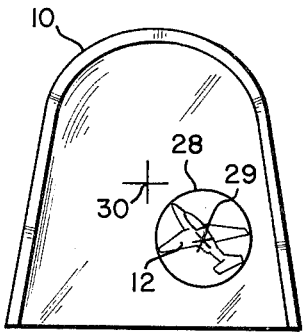
FIG. 5 shows the position of the display symbols at the point in time when the weapon is fired; and , FIG. 6 is a flow diagram illustrative of various operations taking place in the computer block of FIG. 2.

FIGS. 4 and 5 show subsequent relative positions of the various symbols described which are assumed in attacking and firing upon the enemy aircraft.

As indicated by the doted phantom circles in FIG. 3, the direct movement of the reticle 28 towards the target aircraft 12 in response to the movements of the control means of FIG. 2 is illustrated. Line-of-sight tracking is thus manually effected and this angle information is fed into the computer. Also, the ability to vary the diameter of the reticle 28 is shown by the progressively increased diameter of the reticle as depicted in FIGS. 4 and 5. As mentioned in conjunction with FIG. 2, the pilot can manually control the diameter of the reticle 28 to any desired size and in tracking an enemy aircraft, the pilot will attempt to match the size of the aircraft with the diameter of the reticle. Since the relative size of the enemy aircraft varies with range, it will be evident that the reticle signal generated by the pilot in varying the diameter of the reticle constitutes a function of the range and the rate at which the pilot changes the diameter constitutes a function of the rate of change of range, all as described heretofore.

While the line-of-sight tracking and range and range rate information could be provided by a ranging radar, in the preferred embodiment of the invention particularly when firing is on a ground target, the angle or line of sight, range and range rate of the target is best provided by the pilot, thus eliminating the expense of a radar system and the attendant disadvantage of possible jamming thereof.

The computer means 15 of FIG. 2 utilized in solving the required equations may then be any airborne programmable digital computer of sufficient capacity and speed. The required functions solved by the computer means include:

First, fire control equations (balistic equations and range computation equations) providing information to position the firing pipper shown at 29 in FIG. 3. The ballastic equations define the position of a bullet or round as a function of its time of flight $t_f$. Thus, the range of the round or bullet in a horizontal direction is given by $$R_3 = (Va + Vm)\, t_f + D1$$

Where $V_a$ is the speed of the aircraft and $V_m$ is the muzzle velocity of the round or bullet. The coefficient $D_1$ represents corrections for drag and this coefficient would be a function of the aircraft and muzzle velocities also.

The drop rate or range in a vertical direction is given by the ballistic equation:

$$R_v = -gt_f^2 + D_2$$

where $R_v$ is the drop, g acceleration of gravity, and $D_2$ drag or resistance coefficient.

The two coefficients $D_1$ and $D_2$ in the above equations are, as noted, essentially drag coefficients and are functions of the physical properties of the round or bullet being fired.

The foregoing ballistic equations are well known in the art and constitute the standard trajectory equations describing the vertical and horizontal positions of a fired projectile or bullet. The firing pipper position indicates where a bullet fired at any instant in time would hit the sphere having a radius equal to the range determined by the control knob 23. The necessary information to establish the firing pipper position is derived from the range, range rate, and air data provided on lines 24, 25 and block 26 respectively, to the computer means 15. Clearly the position of the firing pipper depends upon the air speed $V_a$ of the aircraft which specific piece of data would be an example of the air data provided by the block 26.

Second, a coordinate transformation of the fire control equation outputs, using the signals provided by the inertial system 27 from the earth coordinates to the aircraft coordinate system. This transformation is applied to the firing pipper position which is displayed to the pilot in aircraft coordinates.

The transformation equations constitute the well known Euler equations, the transformation being indicated in the following table:

$$\begin{array}{c} \\ i \\ j \\ k \end{array} \begin{array}{c} \begin{array}{ccc} \quad l \quad & \quad m \quad & \quad n \quad \end{array} \\ \begin{pmatrix} \cos\psi\cos\theta & \sin\psi\cos\theta & -\sin\theta \\ \cos\psi\sin\theta\sin\Phi - \sin\psi\cos\Phi & \sin\psi\sin\theta\sin\Phi + \cos\psi\cos\Phi & \cos\theta\sin\Phi \\ \cos\psi\sin\theta\cos\Phi + \sin\psi\sin\Phi & \sin\psi\sin\theta\cos\Phi - \cos\psi\sin\Phi & \cos\theta\cos\Phi \end{pmatrix} \end{array} = [E]$$

In the above directional cosine array, $l$, $m$ an $n$ represent the earth coordinates $i$, $j$ and $k$ represent the aircraft coordinates. l represents the rate of change of the range along a first axis on the earth, m represents the rate of change of the range along a second axis of the earth, and n is the rate of change of the range in a vertical direction; that is, a third coordinate axis normal to the other two. The first and second axes on the earth are defined by the heading on the aircraft. Essentially, any pair of coordinate systems can be associated by a sequence of three rotations such as those exemplified above through the angle $\psi$, $\theta$ and $\Phi$.

It will thus be evident that the computer means 15 need only be programmed to solve the above described required equations, the coordinate transformation being performed by part of the computer means 15 from the data supplied by the inertial system 27 utilizing the well known Euler equations as described. The basic equations for controlling the firing piper position are solved by another portion of the computer means 15 from the information provided by the control means in the form of range, and range rate and the information from the air data block 26.

Third, the computer means 15 as described is programmed to effect reticle positioning and size signals on the line 21 directly responsive to movement of the control means 13 to immediately position the reticle 28.

Fourth, the computer means 15 as described is programmed to determine the errors between the firing pipper and reticle positions and generate flight control system commands to reduce that error to zero in which case the round or bullet can be fired.

The programming of suitable computer hardware already available on the market to perform the foregoing operations can readily be carried out by anyone skilled in the art, the ballistic and range computation equations being well known.

Figure 6:
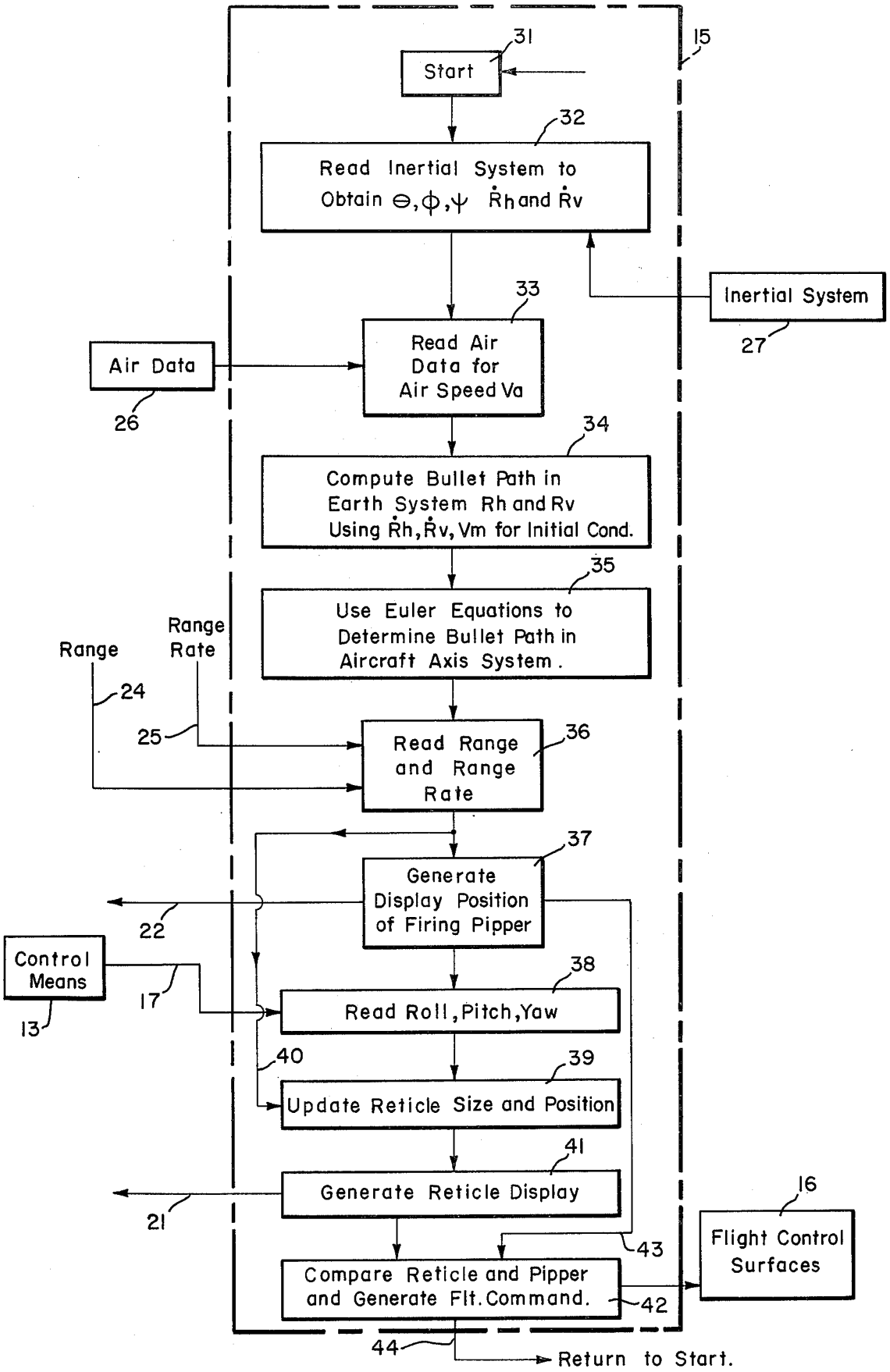

As one specific example, reference is had to FIG. 6 which illustrates in the form of a flow diagram various operations within the computer block 15 depicted by the dot-dashed lines and corresponding to the computer means 15 described in FIG. 2. Thus, there is shown a start block 31 for a read block 32 which reads the inertial system to obtain the Euler coordinate angles $\theta$, $\Phi$ and $\psi$ and to obtain the rate of change of the horizontal component of range indicated $\dot{R}h$ and the rate of change of the vertical range component $\dot{R}v$ both in earth coordinates. The input data to the block 32 is provided by the inertial system block 27 corresponding to the same block 27 in FIG. 2. The output of block 32 passes to block 33 which reads the air data to obtain the air speed Va from the air data block 26 similarly corresponding to the block 26 of FIG. 2.

From the block 33 in FIG. 6, the data is passed to block 34 wherein the bullet path is computed in the earth system to provide Rh and Rv using $\dot{R}h$, $\dot{R}v$, Vm for determining initial conditions. The data from block 34 passes to block 35 which utilizes the Euler equations to determine the bullet path with respect to the aircraft axis system. This data passes to block 36 which also receives the range and range rate information from lines 24 and 25 respectively corresponding to the same lines in FIG. 2 to read the range and range rate.

The block 36 connects to block 37 which generates the proper display position of the firing pipper and passes this information on line 22 to the display generator 20 of FIG. 2. This information is also received in block 38 along with the information concerning roll, pitch and yaw angles from line 17 corresponding to the same line 17 of FIG. 2 from the control means. The block 39 from block 38 together with the range and range rate information from block 36 provided on line 40 utilizes this information to update the size and location or position of the reticle. Block 41 generates the reticle signal data from block 39 to line 21 passing to the display generator 20 of FIG. 2.

The last block 42 in FIG. 6 simply compares the reticle and pipper positions to generate the flight control surface command signals, the firing pipper information being provided on input line 43 to the comparing block 42. The flight control command output signals pass to the flight control surfaces block 16 described in FIG. 2. The bottom outlet arrow 44 schematically indicates a return to the start block 31 at the top of the page, the various computations taking place at the computor's computational speed.

OPERATION

The operation of this invention can best be understood by referring to FIGS. 3, 4, and 5. As described in FIG. 3, there is shown an enemy target aircraft 12 which is to be fired upon by the aircraft 10. The position of the firing pipper 29 indicates where a fired weapon will strike the sphere whose radius from the aircraft is the measured range (due to radar or the pilot vernier) when fired in the direction of the gun line 30. In other words, the position of the firing pipper 29 as determined by the computer takes into account the speed that the aircraft 10 is travelling, its accelerations, inertial attitude, and so forth. Essentially, the gun line is that line from which the bullets appear to come.

When the pilot views the display as shown in FIG. 3, his first step is to cause the generated circular reticle 28 to register with the enemy aircraft 12. The pilot will thus operate his control stick to maneuver the aircraft in the direction of the target aircraft 12, the initial movements of the control stick causing the reticle 28 to move directly towards the target 12 thus overcoming any lag time and actual response of the aircraft. It will also be noted in FIG. 3 and as described heretofore, that the pilot will simultaneously attempt to match the diameter of the reticle 28 to the size of the aircraft 12.

FIG. 4 shows the reticle 28 in registration with the aircraft 12 and properly matched to the size of the aircraft. Since the actual physical size of various types of enemy aircraft are known normally in advance (for example, fifty feed), the pilot will know that if he matches the diameter of the reticle 28 to this sized aircraft the reticle signal passed to the computer constitutes a function of the distance or range of the enemy aircraft from his attacking aircraft. If this range decreases to one half the indicated range or distance in FIG. 4 thereby doubling the size of the target as viewed by the pilot, the reticle diameter will be doubled and the new signal from the computer to the display generator to so increase the diameter of the reticle will represent one half the previous range.

After registering the reticle with the target aircraft as described, the pilot can easily track the aircraft with the reticle all the time making the necessary adjustments in the reticle location and size, thereby feeding line-of-sights range and range rate information to the computer means as described in FIG. 2. It is to be emphasized that this registering and tracking by the reticle is easily accomplished with substantially no lag time since movement of the reticle is tied directly to movement of the control means and vernier through the computer means.

As the tracking progresses, the computer means computes the fire control equations and controls the aircraft flight control surfaces 16 themselves to cause the aircraft to respond to the pilot's command signals so that the firing pipper is caused to register with the reticle.

This latter situation is depicted in FIG. 5 wherein it will be noticed that the firing pipper 29 is directly in coincidence with the target and reticle. At this point, the pilot can fire the weapon or the firing can be effected automatically by the computer.

From the foregoing description, it will thus be evident that the present invention has provided a vastly improved weapon delivery system wherein the normal lag time between movement of the pilot's controls and actual positioning of the aircraft itself to cause registration of a reticle or symbol with the enemy aircraft is eliminated. Problems of oscillation or "hunting" are also eliminated with the result of more rapid tracking and firing as well as substantially increased accuracy.

While the provision of manually generated line-of-sight, range, and range rate signals by the pilot himself as described in conjunction with the thumb control 23 of FIG. 2 eliminate the necessity of line-of-sight and ranging radar equipment and thus constitute important features with respect to air-to-ground weapon delivery, it should be understood that in its broadest aspects, the invention could be used with conventional radar ranging equipment and still retain the advantage of direct reticle movement under control of the pilot.

Moreover, while the head-up display (HUD) has been illustrated in FIG. 2, other equivalent display means such as helmet mounted displays wherein the cathode ray tube is incorporated in the pilot's helmet and the partially transmitting mirror suspended in front of the pilot from the helmet could be used.

The present invention, accordingly, is not to be thought of as limited to the specific examples set forth.

What is claimed is:

1. An aircraft weapon delivery system wherein the aircraft weapon is fixed to the aircraft fuselage and is pointed in the proper weapon firing direction to hit a target by aligning the fuselage in said direction, comprising, in combination:

a. a manual control means for operation by a pilot for generating command signals for maneuvering the aircraft fuselage in flight and for generating target line of sight information;

b. means for generating range and rate of change of range information of said target;

c. air data means for obtaining the velocity, angle of attack and side slip angle of said aircraft;

d. an inertial system for providing inertial attitude and accelerations of said aircraft;

e. display generating means including a display for observation by the pilot;

f. a display generator for projecting a reticle onto said display along with a firing pipper; and g. computer means connected to the control means for actuating the aircraft flight controls in response to command signals generated by movement of the control means, said computer means passing said command signals directly to said display generating means to move said reticle without lag time to a registering position with a target viewed by said pilot, said computer means receiving said line of sight information, range and rate of change of range information, and being connected to the outputs of said air data means and inertial system and utilizing the information and outputs in the weapon delivery equations soled by the computer means, whereby the pilot can register and track the target with said reticle until the firing pipper coincides with the target at which time the weapon can then be fired.

2. The subject matter of claim 1, in which said reticle is in the form of a circle, said means to generate range and rate of change of range information comprising means manually controllable by the pilot for passing a variable reticle signal to said computer means for controlling said display generating means in a manner to vary the diameter of said circle so that the pilot can vary the diameter of the circle to match the visual target, the value of the reticle signal at any given time constituting a function of the range of the target and the rate that the pilot must vary the reticle signal to maintain a matching with the visual target size as it varies constituting a function of the rate of change of said range, whereby the range and range rate in addition to line of sight information are provided by the pilot, thereby eliminating the need for radar equipment to provide this information to the computer means.

* * * * *